US011415153B2

(12) United States Patent
Umeyama et al.

(10) Patent No.: US 11,415,153 B2
(45) Date of Patent: Aug. 16, 2022

(54) CENTRIFUGAL COMPRESSOR

(71) Applicant: KABUSHIKI KAISHA TOYOTA JIDOSHOKKI, Aichi-ken (JP)

(72) Inventors: Ryo Umeyama, Aichi-ken (JP); Yoshiyuki Nakane, Aichi-ken (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 17/378,123

(22) Filed: Jul. 16, 2021

(65) Prior Publication Data

US 2022/0018364 A1 Jan. 20, 2022

(30) Foreign Application Priority Data

Jul. 20, 2020 (JP) ..... JP2020-123640

(51) Int. Cl.

| | |
|---|---|
| ***F04D 29/66*** | (2006.01) |
| ***F04D 29/42*** | (2006.01) |
| ***F04D 29/28*** | (2006.01) |
| ***F04D 17/10*** | (2006.01) |

(52) U.S. Cl.

CPC ..... *F04D 29/667* (2013.01); *F04D 17/10* (2013.01); *F04D 29/284* (2013.01); *F04D 29/4206* (2013.01)

(58) Field of Classification Search

CPC ..... F04D 29/667; F04D 17/10; F04D 29/284; F04D 29/4206; F04D 29/0516; F04D 29/2266

See application file for complete search history.

(56) References Cited

U.S. PATENT DOCUMENTS

| | | | | |
|---|---|---|---|---|
| 5,628,616 | A * | 5/1997 | Lee | F04D 29/2288 415/199.1 |
| 2006/0263200 | A1* | 11/2006 | Ahlroth | F04D 29/2266 415/58.2 |
| 2018/0135643 | A1* | 5/2018 | Kawaguchi | F04D 29/706 |

FOREIGN PATENT DOCUMENTS

| | | | |
|---|---|---|---|
| JP | 2018-168707 | A | 11/2018 |

* cited by examiner

*Primary Examiner* — Sabbir Hasan

(74) *Attorney, Agent, or Firm* — Greenblum & Bernstein, P.L.C.

(57) ABSTRACT

A centrifugal compressor comprises a rotation shaft, an impeller, and a casing. The impeller has a hub and a plurality of blades. The casing has an opposite surface facing a back surface of the hub, and a projection projecting from the opposite surface toward the impeller. The hub is provided with an accommodation space that accommodates the projection. The accommodation space includes a through hole penetrating the hub from the back surface toward an external radial surface. The through hole opens while avoiding the blades.

9 Claims, 5 Drawing Sheets

CENTRIFUGAL COMPRESSOR

This nonprovisional application is based on Japanese Patent Application No. 2020-123640 filed on Jul. 20, 2020 with the Japan Patent Office, the entire contents of which are hereby incorporated by reference.

BACKGROUND OF THE INVENTION

Field of the Invention

The present invention relates to a centrifugal compressor.

Description of the Background Art

For example, Japanese Patent Laid-Open No. 2018-168707 discloses a centrifugal compressor including an impeller. The impeller in the centrifugal compressor has a hub having an external radial surface and a back surface, and a plurality of blades. The hub is provided with a through hole formed therethrough between the external radial surface and the back surface. The through hole thus formed reduces a moment of inertia of the impeller and a thrust load acting on the impeller.

SUMMARY OF THE INVENTION

In the centrifugal compressor described in Japanese Patent Laid-Open No. 2018-168707, a portion of an air current flowing toward a discharging side along the external radial surface of the hub may flow toward the back surface of the impeller through the through hole, or an air stream formed by the impeller may return from a side discharging the air current (e.g., from a diffuser) to the external radial surface of the impeller through a gap formed between the back surface of the impeller and a rear housing as well as the through hole. This entails poor performance (or a reduced pressure ratio), or increased power to drive the impeller.

An object of the present invention is to provide a centrifugal compressor capable of achieving both reduction in moment of inertia of an impeller and in thrust load acting on the impeller, and suppression of reduction in pressure ratio.

A centrifugal compressor according to an aspect of the present invention is a centrifugal compressor comprising a rotation shaft, an impeller fixed to the rotation shaft and rotating together with the rotation shaft, and a casing that accommodates the rotation shaft and the impeller, the impeller including a hub having an external radial surface having a shape gradually increasing in diameter from one side of the rotation shaft toward the other side of the rotation shaft and a back surface formed on the other side of the rotation shaft, and a plurality of blades provided on the external radial surface of the hub, the casing having an opposite surface facing the back surface of the hub, and a projection projecting from the opposite surface toward the impeller, the hub having formed therein an accommodation space overlapping with the projection in a radial direction of the rotation shaft, extending annularly about an axis of the rotation shaft, and accommodating the projection, the accommodation space including a through hole penetrating the hub from the back surface toward the external radial surface, the through hole opening while avoiding the blades.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will now be described with reference to the drawings. In the figures referred to below, any identical or equivalent member is identically denoted.

Figure 1:
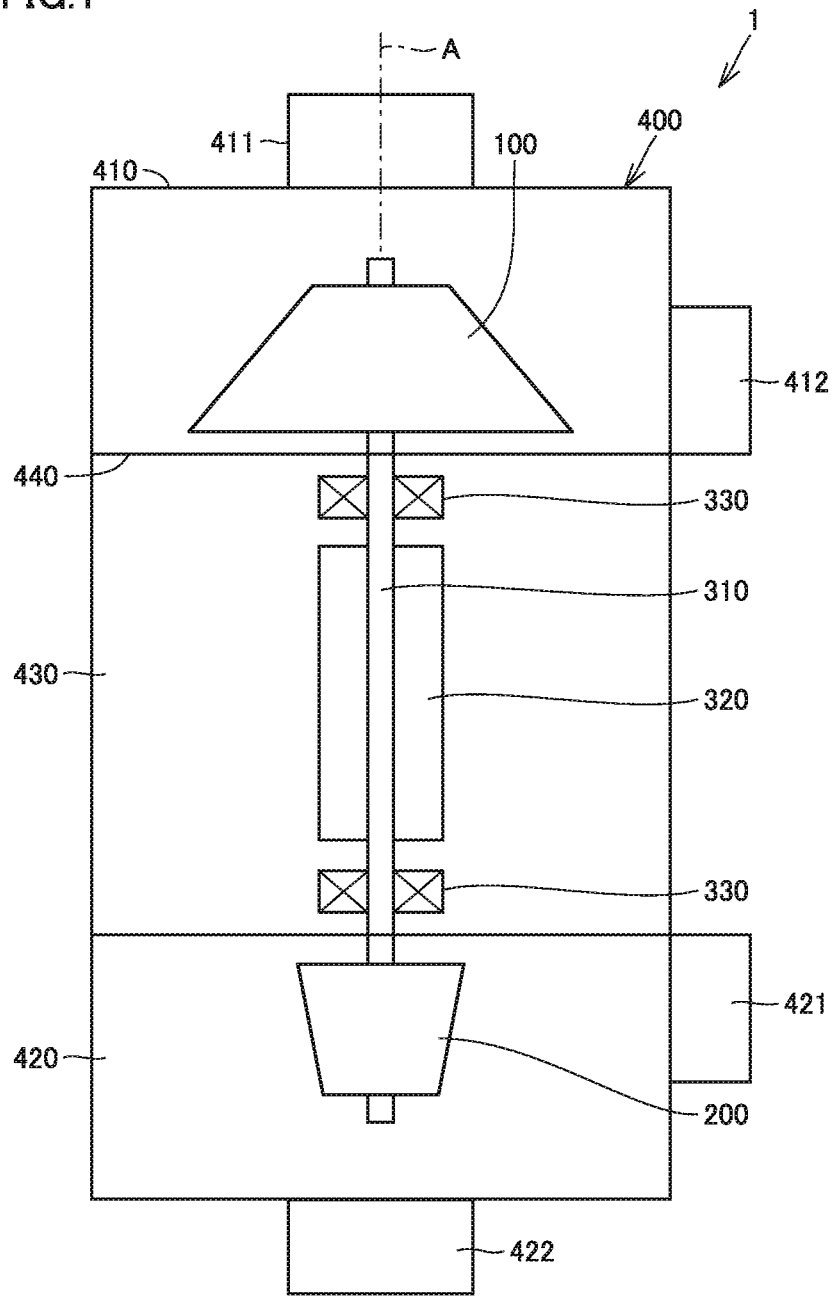
FIG. 1 is a diagram schematically showing a configuration of a centrifugal compressor according to an embodiment of the present invention.

FIG. 1 is a diagram schematically showing a configuration of a centrifugal compressor according to an embodiment of the present invention. As shown in FIG. 1, the centrifugal compressor 1 includes an impeller 100, a turbine wheel 200, a rotation shaft 310, a motor 320, a bearing 330, and a casing 400.

The rotation shaft 310 interconnects the impeller 100 and the turbine wheel 200. The rotation shaft 310 is rotationally driven by the motor 320. The rotation shaft 310 is received by bearing 330. The motor 320 includes a rotor and a stator (not shown).

The casing 400 houses the impeller 100, the turbine wheel 200, the rotation shaft 310, the motor 320, and the bearing 330. The casing 400 has a compressor housing 410, a turbine housing 420, and a center housing 430.

The compressor housing 410 houses the impeller 100. The compressor housing 410 has a suction port 411 and a discharge unit 412. A diffuser (not shown) is provided in the compressor housing 410 on a discharging side of the impeller 100.

The turbine housing 420 houses the turbine wheel 200. The turbine housing 420 has a suction unit 421 and a discharge port 422.

The center housing 430 is disposed between the compressor housing 410 and the turbine housing 420. The center housing 430 houses the motor 320 and the bearing 330.

The center housing 430 has a rear housing 440. That is, the casing 400 includes the rear housing 440. The rear housing 440 is disposed on the side of the back surface of the impeller 100. The rear housing 440 is provided between the impeller 100 and the bearing 330. The rear housing 440 will more specifically be described hereinafter.

Figure 2:
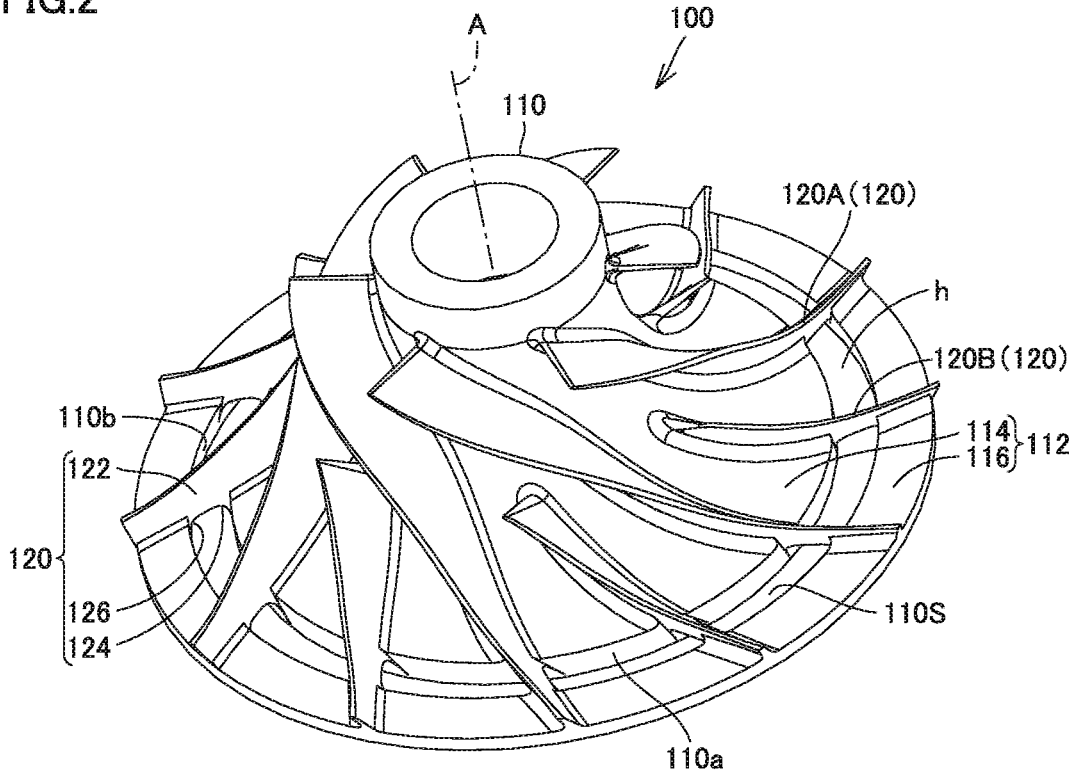
FIG. 2 is a perspective view of an impeller.
Figure 3:
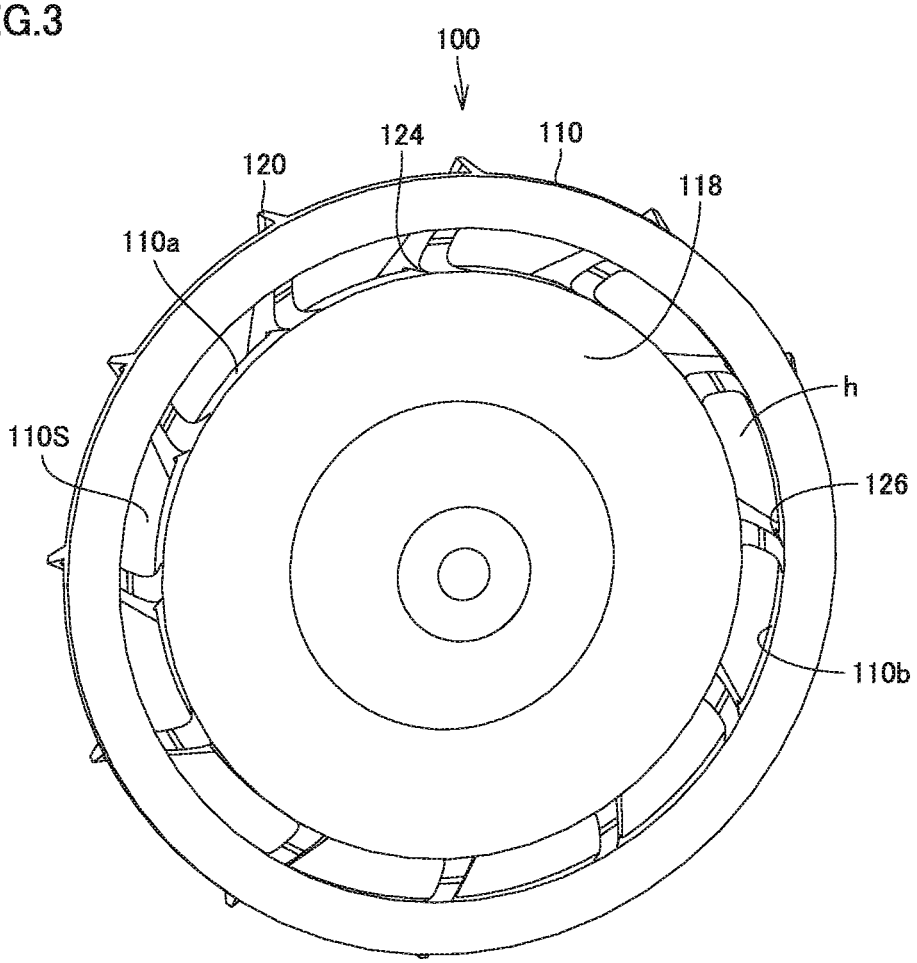
FIG. 3 is a perspective view of the impeller at an angle different from that in FIG. 2.

The impeller 100 receives gas (e.g., air) sucked through the suction port 411 and discharges the gas through the discharge unit 412. The impeller 100 is fixed to the rotation shaft 310 and rotates about an axis A together with the rotation shaft 310. As shown in FIGS. 2 and 3, the impeller 100 includes a hub 110 and a plurality of blades 120.

The hub 110 is fixed to the rotation shaft 310 and is rotatable about the axis A. In the present embodiment, the axis A corresponds to an axis of center of rotation of the rotation shaft 310. The hub 110 has an external radial surface 112 and a back surface 118.

The external radial surface 112 has a shape increasing in diameter from one side (an upper side in FIG. 1) of the rotation shaft 310 (the axis of center of rotation) toward the other side (a lower side in FIG. 1) of the rotation shaft 310.

In other words, the external radial surface 112 has a shape having an outer diameter gradually increasing from an end portion on the suction side toward an end portion on the discharging side. As the external radial surface 112 extends from one side toward the other side, the external radial surface 112 has a shape curved to be convex in a direction approaching the rotation shaft 310.

The back surface 118 is orthogonal to the axis A. The back surface 118 is formed on the other side (or the discharging side). The back surface 118 is formed flat.

The hub 110 is provided with an accommodation space 110S extending annularly about the axis A of the rotation shaft 310. In the accommodation space 110S, a through hole h is formed to penetrate the hub 110 from the back surface 118 toward the external radial surface 112. The through hole h penetrates the hub 110 in a direction parallel to the axis A. The through hole h is preferably formed near an outer edge of the hub 110. The through hole h opens while avoiding the blades 120, which will be described hereinafter.

The external radial surface 112 of the hub 110 has an inner external radial surface 114 and an outer external radial surface 116.

The inner external radial surface 114 is an external radial surface located inwardly of the through hole h in the radial direction of the hub 110.

The outer external radial surface 116 is an external radial surface located outwardly of the through hole h in the radial direction. In the present embodiment, the outer external radial surface 116 is formed in an annulus (or a ring). The back surface 118 behind the outer external radial surface 116 is flush with the back surface 118 behind the inner external radial surface 114.

Each blade 120 is provided on the external radial surface 112 of the hub 110. Each blade 120 has a shape extending from the inner external radial surface 114 to reach the outer external radial surface 116. Each blade 120 connects the inner external radial surface 114 and the outer external radial surface 116. The plurality of blades 120 have a plurality of first blades 120A and a plurality of second blades 120B.

The first blade 120A has a shape extending to reach the outer external radial surface 116 from the inner external radial surface 114 in a vicinity of one end thereof located on the one side.

The second blade 120B has a shape extending to reach the outer external radial surface 116 from a radially middle portion of the inner external radial surface 114.

Figure 4:
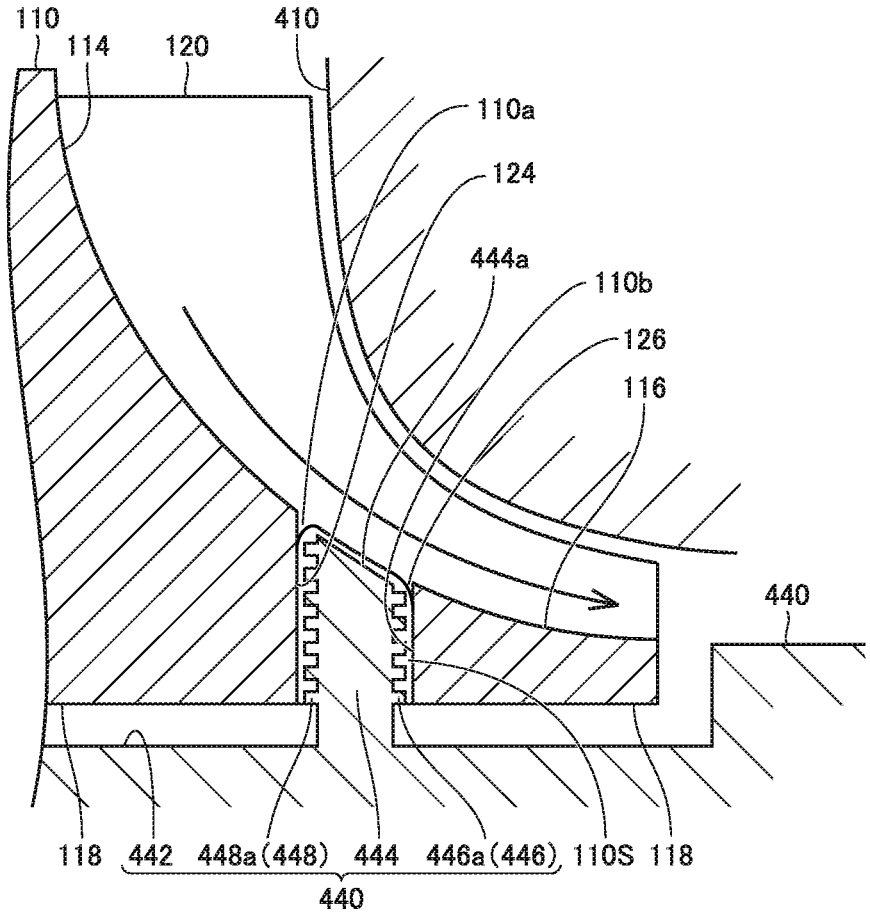
FIG. 4 schematically shows the impeller and a rear housing in cross section.

As shown in FIGS. 2 to 4, each blade 120 has a blade body 122, an inner connecting portion 124, and an outer connecting portion 126.

The blade body 122 has a shape extending from the inner external radial surface 114 to reach the outer external radial surface 116. The blade body 122 connects the inner external radial surface 114 and the outer external radial surface 116. The blade body 122 is tilted in a direction in which the hub 110 rotates.

The inner connecting portion 124 is provided at a boundary portion between the blade body 122 and a portion 110*a* of a side surface defining the accommodation space 110S in the hub 110 that is closer to the axis A. As the inner connecting portion 124 is farther away from the back surface 118, the inner connecting portion 124 has a shape curved to be convex in a direction approaching the axis A.

The outer connecting portion 126 is provided at a boundary portion between the blade body 122 and a portion 110*b* of a side surface defining the accommodation space 110S in the hub 110 that is farther from the axis A. As the outer connecting portion 126 is farther away from the back surface 118, the outer connecting portion 126 has a shape curved to be convex in a direction farther away from the axis A.

The rear housing 440 will now be described. As shown in FIG. 4, the rear housing 440 has an opposite surface 442, a projection 444, a backflow suppressor 446, and a leakage suppressor 448.

The opposite surface 442 faces the back surface 118 of the impeller 100. The opposite surface 442 is formed flat.

The projection 444 has a shape projecting from the opposite surface 442 toward the impeller 100, and is disposed in the accommodation space 110S. That is, the projection 444 overlaps with the accommodation space 110S in the radial direction of the rotation shaft 310, and is accommodated in the accommodation space 110S. The projection 444 is formed annularly throughout the accommodation space 110S without interruption. The projection 444 is orthogonal to the opposite surface 442. The projection 444 has a tip 444*a*, which has a shape approaching the opposite surface 442 as tip 444*a* extends outwards in the radial direction (toward a right side in FIG. 4). The tip 444*a* may be shaped to follow a portion of the blade body 122 that faces the tip 444*a* in a direction parallel to the axis A (i.e., a vertical direction in FIG. 4) (i.e., a portion thereof between the inner connecting portion 124 and the outer connecting portion 126).

The backflow suppressor 446 suppresses formation of an air current formed by the impeller that returns from a side that discharges the air current to the external radial surface 112 of the hub 110 through a gap formed between the back surface 118 of the hub 110 and the opposite surface 442 and a gap formed between a side surface of the projection 444 outer in the radial direction of the hub 110 and the portion 110*b*. In the present embodiment, the backflow suppressor 446 is connected to the side surface of the projection 444 outer in the radial direction.

The backflow suppressor 446 has a plurality of backflow suppressing elements 446*a* spaced and thus aligned in a direction in which the projection 444 projects (i.e., in an upward direction in FIG. 4). Each backflow suppressing element 446*a* has a shape extending in a circumferential direction of the hub 110. Each backflow suppressing element 446*a* is formed in a circumferential direction of the projection 444 in the form of an annulus circumferentially of the projection 444 without interruption.

The leakage suppressor 448 suppresses formation of an air current flowing toward the back surface 118 of the hub 110 through a gap formed between a side surface of the projection 444 inner in the radial direction of the hub 110 and the portion 110*a*. In the present embodiment, the leakage suppressor 448 is connected to the side surface of the projection 444 inner in the radial direction of the hub 110.

The leakage suppressor 448 has a plurality of leakage suppressing elements 448*a* spaced and thus aligned in the direction in which the projection 444 projects. Each leakage suppressing element 448*a* has a shape extending in the circumferential direction of the hub 110. Each leakage suppressing element 448*a* is formed in the circumferential direction of the projection 444 in the form of an annulus circumferentially of the projection 444 without interruption.

Thus, the centrifugal compressor 1 having the projection 444 disposed in the accommodation space 110S of the impeller 100 according to the present embodiment suppresses a portion of an air current flowing toward a discharging side along the external radial surface 112 of the hub 110 that proceeds towards the back surface 118 of the hub 110 through the through hole h, and suppresses formation of an air stream formed by the impeller 100 that returns from a side discharging the air current (e.g., from a diffuser) to the external radial surface 112 of the hub 110 through a gap formed between the back surface 118 of the hub 110 and the opposite surface 442 as well as the through hole h. The centrifugal compressor 1 thus achieves both reduction in moment of inertia of the impeller 100 and in thrust load acting on the impeller 100, and suppression of reduction in pressure ratio.

For example, the projection 444 may not be formed in an annulus without interruption, and may instead be formed at intervals in the circumferential direction of the hub 110.

Further, the blades 120 may all be shaped identically.

Figure 5:
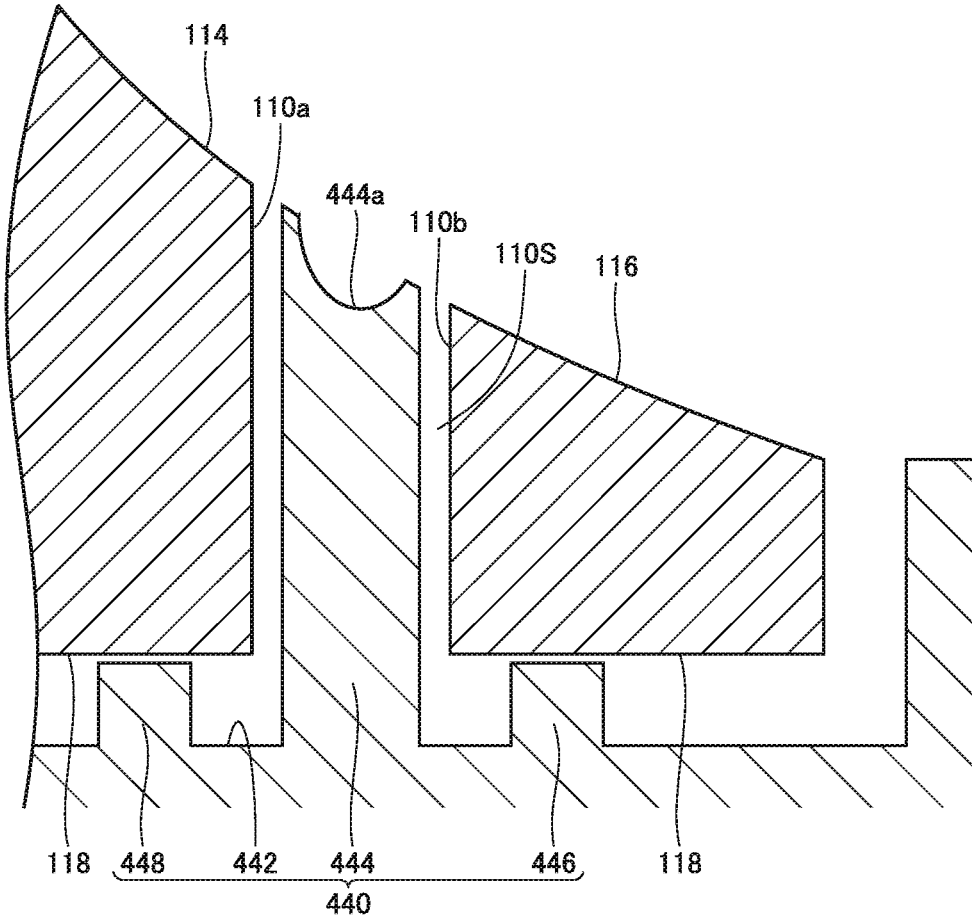
FIG. 5 schematically show a modified example of the rear housing in cross section.

Further, as shown in FIG. 5, the tip 444*a* of the projection 444 may have a shape recessed toward the opposite surface 442. Further, the backflow suppressor 446 may be provided at a portion of the opposite surface 442 overlapping with the outer external radial surface 116 in the direction parallel to the axis A. The leakage suppressor 448 may be provided at a portion of the opposite surface 442 overlapping with the inner external radial surface 114 in the direction parallel to the axis A.

[Manner]

It will be appreciated by those skilled in the art that the above exemplary embodiment is a specific example of the following manner:

A centrifugal compressor according to an aspect of the present disclosure is a centrifugal compressor comprising a rotation shaft, an impeller fixed to the rotation shaft and rotating together with the rotation shaft, and a casing that accommodates the rotation shaft and the impeller, the impeller including a hub having an external radial surface having a shape gradually increasing in diameter from one side of the rotation shaft toward the other side of the rotation shaft and a back surface formed on the other side of the rotation shaft, and a plurality of blades provided on the external radial surface of the hub, the casing having an opposite surface facing the back surface of the hub, and a projection projecting from the opposite surface toward the impeller, the hub having formed therein an accommodation space overlapping with the projection in a radial direction of the rotation shaft, extending annularly about an axis of the rotation shaft, and accommodating the projection, the accommodation space including a through hole penetrating the hub from the back surface toward the external radial surface, the through hole opening while avoiding the blades.

Thus, the present centrifugal compressor that has the projection disposed in the accommodation space of the impeller suppresses a portion of an air current flowing toward a discharging side along the external radial surface of the hub that proceeds towards the back surface of the hub through the through hole, and suppresses formation of an air stream formed by the impeller that returns from a side discharging the air current (e.g., from a diffuser) to the external radial surface of the hub through a gap formed between the back surface of the hub and the rear housing as well as the through hole. The present centrifugal compressor thus achieves both reduction in moment of inertia of the impeller and in thrust load acting on the impeller, and suppression of reduction in pressure ratio.

Further, the projection is preferably formed annularly throughout the accommodation space without interruption.

This further reliably suppresses reduction in pressure ratio.

Further, preferably, the casing includes a rear housing disposed on the side of the back surface of the impeller, and the rear housing has a backflow suppressor to suppress formation of an air current formed by the impeller that returns from a side that discharges the air current to the external radial surface of the hub through a gap formed between the back surface of the hub and the opposite surface and a gap formed between a side surface of the projection outer in the radial direction of the hub and the hub.

This further reliably suppresses reduction in pressure ratio.

In this case, preferably, the backflow suppressor is connected to the side surface of the projection outer in the radial direction of the hub.

Further, preferably, the leakage suppressor has a plurality of leakage suppressing elements spaced and thus aligned in a direction in which the projection projects, and the backflow suppressing elements each have a shape extending in a circumferential direction of the hub.

Further, preferably, the casing includes a rear housing disposed on the side of the back surface of the impeller, and the rear housing has a leakage suppressor to suppress formation of an air current flowing toward the back surface of the hub through a gap formed between a side surface of the projection inner in the radial direction of the hub and the hub.

This further reliably suppresses reduction in pressure ratio.

In this case, the leakage suppressor is preferably connected to the side surface of the projection inner in the radial direction of the hub.

Further, preferably, the leakage suppressor has a plurality of leakage suppressing elements spaced and thus aligned in the direction in which the projection projects, and the leakage suppressing elements each have a shape extending in the circumferential direction of the hub.

Further, the projection preferably has a tip shaped to be recessed toward the opposite surface.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. A centrifugal compressor comprising:

a rotation shaft;

an impeller fixed to the rotation shaft and rotating together with the rotation shaft; and a casing that accommodates the rotation shaft and the impeller, the impeller including a hub having an external radial surface having a shape gradually increasing in diameter from one side of the rotation shaft toward the other side of the rotation shaft, and a back surface formed on the other side of the rotation shaft, and a plurality of blades provided on the external radial surface of the hub, the casing having an opposite surface facing the back surface of the hub, and a projection projecting from the opposite surface toward the impeller, the hub having formed therein an accommodation space overlapping with the projection in a radial direction of the rotation shaft, extending annularly about an axis of the rotation shaft, and accommodating the projection, the accommodation space including a through hole (h) penetrating the hub from the back surface toward the external radial surface, the through hole (h) opening while avoiding the plurality of blades.

2. The centrifugal compressor according to claim 1, wherein the projection is annularly formed throughout the accommodation space without interruption.

3. The centrifugal compressor according to claim 1, wherein the casing includes a rear housing disposed on a side of the back surface of the impeller, and the rear housing has a backflow suppressor to suppress formation of an air current formed by the impeller that returns from a side that discharges the air current to the external radial surface of the hub through a gap formed between the back surface of the hub and the opposite surface and a gap formed between a side surface of the projection outer in the radial direction of the hub and the hub.

4. The centrifugal compressor according to claim 3, wherein the backflow suppressor is connected to the side surface of the projection outer in the radial direction of the hub.

5. The centrifugal compressor according to claim 4, wherein the backflow suppressor has a plurality of backflow suppressing elements spaced and thus aligned in a direction in which the projection projects, and the plurality of backflow suppressing elements each have a shape extending in a circumferential direction of the hub.

6. The centrifugal compressor according to claim 1, wherein the casing includes a rear housing disposed on a side of the back surface of the impeller, and the rear housing has a leakage suppressor to suppress formation of an air current flowing toward the back surface of the hub through a gap formed between a side surface of the projection inner in the radial direction of the hub and the hub.

7. The centrifugal compressor according to claim 6, wherein the leakage suppressor is connected to the side surface of the projection inner in the radial direction of the hub.

8. The centrifugal compressor according to claim 7, wherein the leakage suppressor has a plurality of leakage suppressing elements spaced and thus aligned in a direction in which the projection projects, and the plurality of leakage suppressing elements each have a shape extending in a circumferential direction of the hub.

9. The centrifugal compressor according to claim 1, wherein the projection has a tip shaped to be recessed toward the opposite surface.

* * * * *